US007165292B2

(12) United States Patent
Kasai

(10) Patent No.: US 7,165,292 B2
(45) Date of Patent: Jan. 23, 2007

(54) PLASTIC CHUCK WITH WRONG OPENING PREVENTING SLIDER, AND BAG WITH THE CHUCK

(75) Inventor: Juichi Kasai, Tokyo (JP)

(73) Assignee: Showa Highpolymer Co., Ltd., Tokyo (JP)

( * ) Notice: Subject to any disclaimer, the term of this patent is extended or adjusted under 35 U.S.C. 154(b) by 529 days.

(21) Appl. No.: 10/450,060

(22) PCT Filed: Dec. 6, 2001

(86) PCT No.: PCT/JP01/10688

§ 371 (c)(1),
(2), (4) Date: Jun. 11, 2003

(87) PCT Pub. No.: WO02/47993

PCT Pub. Date: Jun. 20, 2002

(65) Prior Publication Data

US 2004/0045138 A1 Mar. 11, 2004

(30) Foreign Application Priority Data

Dec. 11, 2000 (JP) ..... 2000-375501

(51) Int. Cl.
*B65D 33/25* (2006.01)
*A44B 19/16* (2006.01)

(52) U.S. Cl. ..... 24/30.5 R; 24/400; 383/64

(58) Field of Classification Search ..... 24/399, 24/400, 427, 415, 585.11, 585.12, 30.5 R, 24/387, 30 R; 383/64
See application file for complete search history.

(56) References Cited

U.S. PATENT DOCUMENTS

| | | | | |
|---|---|---|---|---|
| 3,713,923 | A * | 1/1973 | Laguerre | 24/427 |
| 5,664,299 | A * | 9/1997 | Porchia et al. | 24/400 |
| 5,689,866 | A * | 11/1997 | Kasai et al. | 24/400 |
| 5,983,466 | A * | 11/1999 | Petkovsek | 24/400 |
| 6,481,890 | B1 * | 11/2002 | VandenHeuvel | 383/64 |
| 6,739,755 | B1 * | 5/2004 | Schreiter | 383/64 |

FOREIGN PATENT DOCUMENTS

| | | |
|---|---|---|
| JP | 8-324595 | 12/1996 |
| JP | 2000-503241 | 3/2000 |

* cited by examiner

*Primary Examiner*—Robert J. Sandy
(74) *Attorney, Agent, or Firm*—Oblon, Spivak, McClelland, Maier & Neustadt, P.C.

(57) ABSTRACT

A plastic zipper includes a pair of male hooks and female hooks for a slider guide operable parallel to the hooks for sealing on the opening side of the zipper wherein, at the same time, an inside guide of the slider is positioned between the hooks for sealing and hooks for slider guide in the case of a plastic zipper equipped with a slider.

8 Claims, 8 Drawing Sheets

PRIOR ART

PLASTIC CHUCK WITH WRONG OPENING PREVENTING SLIDER, AND BAG WITH THE CHUCK

TECHNICAL FIELD

The present invention relates to a plastic zipper equipped with a slider which is employed in packaging materials for food, pharmaceutical and electronic part item, which is capable of opening with ease and resealing even after a plurality of opening and closing operations while maintaining hermetical sealability, and is preventive against unfair unsealing. It is also concerned with a bag body fitted with the above-mentioned plastic zipper.

BACKGROUND ART

There are widely employed, as packaging materials for a variety of articles in the fields of foods, pharmaceuticals, electronic part items and the like, bag bodies each fitted with a plastic zipper. In particular, there are widely employed plastic zippers each equipped with a slider because of a ease in opening and closing and its capability of resealing.

FIG. 1 is a cross sectional end view showing a conventional plastic zipper the construction of which is such that a male hook M1-1 and female hooks F1-1 and F1-2 are engaged with each other so that the zipper is sealed. A slider which is usually employed for opening and closing the zipper is composed generally of an outside guide and an inside guide in such a structure that the inside guide which is inserted between the male hook and the female hooks slides so as to cause the male/female hooks to disengage, while the outside guide which sandwiches the male/female hooks therein slides so as to cause the male/female hooks to engage {refer to Japanese Patent Application Laid-Open No. 214920/1996 (Heisei 8)}.

However, with regard to the slider of the conventional structure, the inside guide is inserted between the hooks of a zipper, and even if the zipper is completely bound tight, the content in a bag leaks between the hooks and the inside guide which is inserted between the hooks. Hence, the above-mentioned conventional zipper is unusable for applications which require hermetical sealing and thus is used only for applications in no need of hermetical sealing such as general cargoes.

On the other hand, there is proposed a plastic zipper having such a structure that hermetical sealing can be maintained in a state of a engagement with a slider by the use of a specially shaped plastic zipper and a slider adapted thereto (for instance, U.S. Pat. Nos. 5,067,208 and 5,664,299). In regard to the plastic zippers as disclosed therein, hermetical sealability is maintained by taking advantage of the elasticity of the plastic material which constitutes the zipper for the purpose of facilitating the disengagement even with a weak force, and therefore when the elasticity thereof varies with a variation in temperature or the like, it is made impossible to maintain the hermetical sealability after opening and closing operations, whereby the amount of leakage is increased. Such being the case, the above-proposed zippers are unusable for packaging such content as liquid and the like in which occurrence of leakage is forbidden.

In the interim, there is proposed a zipper which comprising a pair of male hook/female hooks formed on a surface of a plastic film, a continuous tightening wall which is installed parallel to said male hook on the inside of said male hook and a continuous pressing rib which is installed parallel to said female hooks on the inside of said female hooks, whereby the zipper is imparted with excellent properties in persistent hermetical sealability and also impact resistance by the tight contact between the continuous tightening wall and the continuous pressing rib as well as self-tightening effect thereof (hereinafter referred to as "hermetically sealable zipper") (Japanese Patent Registration No. 2,938,784).

FIG. 2 is a cross sectional end view showing the aforesaid hermetically sealable zipper in which the continuous tightening wall R 1 which is installed parallel to the male hooks M2-1, M2-2 on the inside of said male hooks and the continuous pressing rib which is installed parallel to the female hooks F2-1, F2-2 on the inside of said female hooks come in tight contact with each other and tighten the same. The above-mentioned hermetically sealable zipper, which is excellent in hermetical sealability and impact resistance and is almost free from performance variation due to temperature variation, is well suited for use in packaging liquid and the like.

The conventional slider with such constitution that the inside guide is inserted between the male hook and the female hooks, when used in the above-mentioned hermetically sealable zipper, impairs the much-awaited hermetical sealability. In such circumstance,. as a solution for this problem, the present inventor previously proposed a plastic zipper which is equipped with a slider and in which protrusions for slider guide are installed each parallel to a male hook and a female hook of a pair of male/female hooks in the opening side (outside) of the pair of male/female hooks for the plastic zipper, and the inside guide of the slider is positioned between the protrusions and the hooks in the opening side of the hooks therefor {Japanese Patent Application No. 316469/1999 (Heisei 11)}.

FIG. 3 is a cross sectional end view showing a plastic zipper equipped with protrusions for slider guide which is provided with protrusions G1-1, G1-2 each parallel to a male hook M2-1 and a female hook F2-1. FIG. 4 is a perspective view showing a slider to be employed for the zipper just mentioned. FIG. 5 is a cross sectional end view taken along the line B–B" of FIG. 4 in which the slider S is composed of an inside guide S1 and an outside guide S2. FIG. 6 is a cross sectional end view showing a state in which the zipper is closed with a pair of male/female hooks that are sandwiched by the outside guide S2. FIG. 7 is a cross sectional end view showing a state in which the zipper is opened with the slider inside guide S1 positioned between the male hook M2-1 and the female hook F2-1 and the protrusions G1-1, G1-2. By the sliding of the slider equipped with the inside guide of the shape as illustrated on FIG. 5, the state of the slider is continuously changed from the state shown on FIG. 6 to the state shown on FIG. 7 via an intermediate state and vice versa, so that closing and opening of the zipper is carried out.

As a further improvement as illustrated on the perspective view of FIG. 8 in Japanese Patent Application No. 316469/1999 (Heisei 11), a proposal is made to ensure the closing of the zipper and tight contact of zipper parts by means of such constitution that a terminal portion of a plastic zipper for a bag body fitted with a plastic zipper is usually sealed on a heat seal portion HS, whereas there are provided, at a position immediately before the heat seal portion, hollows H1, H2 which are intended for stopping the inside guide and which penetrate between the top of the hooks F2-1, M2-1 on the opening side and the protrusions G1-1, G1-2 for slider guide.

Accompanying the diversification of objects to be packaged in recent years, higher hermetical sealability is required of the plastic zipper. At the same time, it is desired that the zipper be endowed with the function capable of detection of its having been unsealed after sealing packaging for the purpose of preventing unsealing thereafter due to an unfair purpose or mistake which brings about such disadvantages that foreign matters are mixed in the package and/or the quality of the content therein is impaired.

However, the above-mentioned plastic zipper equipped with a slider suffers from the disadvantage of its incapability of preventing unfair unsealing, since the zipper in a state of being closed can be opened by pulling from the outside, the protrusion portion for slider guide.

DISCLOSURE OF THE INVENTION

As a result of intensive research and investigation made by the present inventor, it has been made possible to develop a plastic zipper which is equipped with a slider, imparted with a high degree of hermetical sealability, and easy to unseal and reopen/reclose; a plastic zipper which is equipped with a slider, and capable of further preventing unfair unsealing not using a slider; and a bag body fitted with the above-mentioned plastic zipper with a slider.

Specific means for solving the above-mentioned problems are summarized as follows:

1. A plastic zipper equipped with a slider and a preventive against unintentional unsealing, comprising a pair of male hooks and female hooks for sealing formed on a surface of a plastic film, and a pair of male hooks and female hooks for slider guide which are installed parallel to the hooks for sealing on the opening side of the zipper so that an inside guide of the slider is positioned between the hooks for sealing and the hooks for slider guide.

2. A plastic zipper equipped with a slider and a preventive against unintentional unsealing, comprising a pair of male hook and female hook for sealing formed on a surface of a plastic film, a continuous tightening wall which is installed parallel to the male hook on the inside of the male hook, a continuous pressing rib which is installed parallel to the female hook on the inside of the female hook, and a pair of male hook and female hook for slider guide which are installed parallel to the hooks for sealing on the opening side of the zipper so that an inside guide of the slider is positioned between the hooks for sealing and the hooks for slider guide.

3. The plastic zipper equipped with a slider and a preventive against unintentional unsealing as set forth in the preceding item 1 or 2, wherein the hooks for slider guide have each an opening strength of at least 4 kgf/50 mm as a strength of opening from the opening side.

4. A bag body fitted with the plastic zipper equipped with a slider as set forth in any of the preceding items 1 through 3.

DETAILED DESCRIPTION OF THE PREFERRED EMBODIMENTS

The embodiments of the present invention will be described in more detail with reference to the related drawings.

The plastic zipper equipped with a slider according to the present invention is that in which hooks for slider guide are installed in place of protrusions for slider guide G1-1 and G1-2 in the plastic zipper equipped with a slider as illustrated on FIG. 3 through FIG. 7 which was previously applied for a patent as the above-mentioned Japanese Patent Application No. 316469/ 1999 (Heisei 11).

Figure 9:
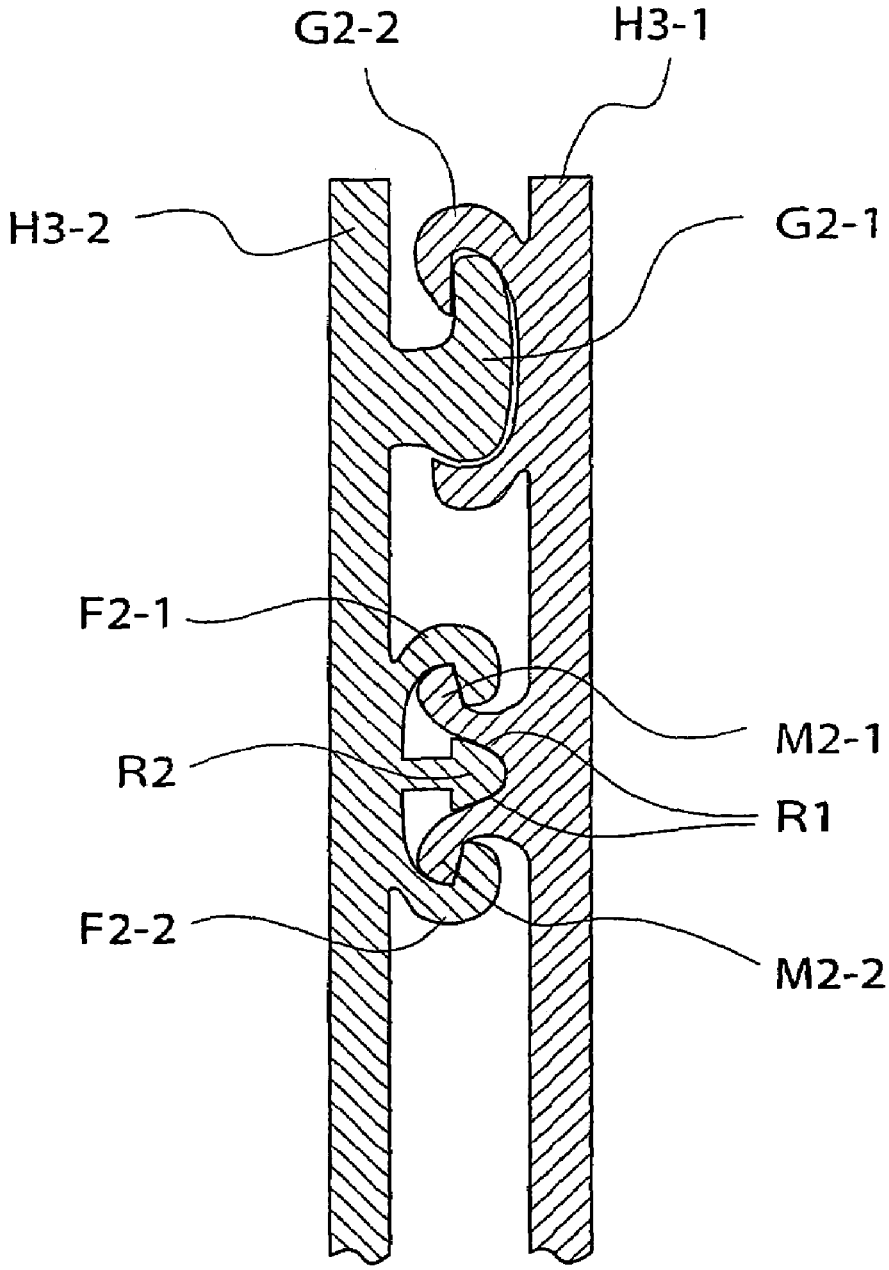
FIG. 9 is a cross sectional end view showing a hermetically sealable plastic zipper which is equipped with a pair of hooks for slider guide according to the present invention.

That is to say, FIG. 9 is a cross sectional end view showing one embodiment of a hermetically sealable plastic zipper according to the present invention, in which a pair of male and female hooks for slider guide G2-1 and G2-2 are installed parallel to the inherent sealing hooks which constitute the hermetically sealable zipper comprising male hooks M2-1 and M2-2, a continuous tighting wall R-1, female hooks F2-1 and F2-2 and a continuous pressing rib R-2. Though the embodiment as illustrated on FIG. 9 points out the hermetically sealable zipper on which the hooks for slider guide are installed, the embodiment may be such that the hooks therefor are installed on flanges of a conventional zipper as illustrated on FIG. 10.

In addition, it is made possible to further enhance the working effect inherent in the present invention including the effect on the prevention against unfair unsealing by constituting the zipper in such a manner that an easily peelable plastic layer is installed in advance, on either or both of the continuous tightening wall and continuous pressing rib for the hermetically sealable zipper or on either or both of the male hook and female hook for a conventional zipper so that the continuous tightening wall and the continuous pressing rib or the male and female hooks are brought into close contact with each other via the easily peelable plastic layer at the time of hermetical sealing, or by constituting the zipper in such a manner that in addition to the foregoing, the color of the easily peelable plastic layer is made different from the color of the object to be brought into close contact so that the color at the time of close contact changes when the plastic layer is peeled.

The slider to be used in the plastic zipper equipped with a slider according to the present invention is the slider to be used in the plastic zipper equipped with a slider in the above-mentioned Japanese Patent Application No. 316469/1999 (Heisei 11), and is the same in form, shape and function as that described with reference to FIG. 4 through FIG. 7.

Figure 11:
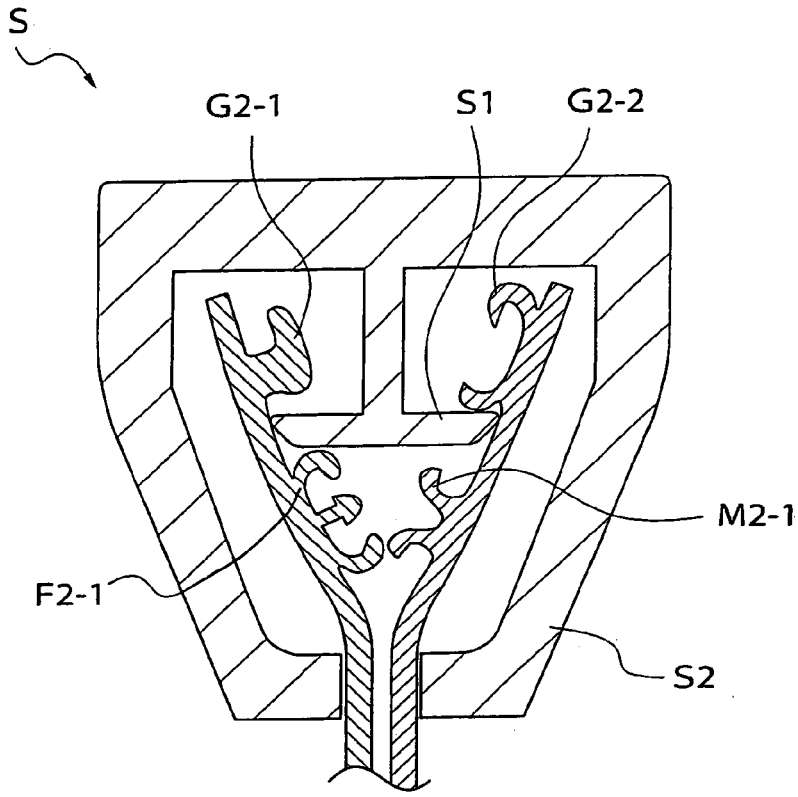
FIG. 11 is a cross sectional end view showing a state in which a hermetically sealable plastic zipper which is equipped with a pair of hooks for slider guide according to the present invention is opened by being widened by the inside guide.

FIG. 11 is a cross sectional view showing a state in which a slider is mounted on the zipper as illustrated on FIG. 9 so as to open the zipper, specifically the zipper is opened by widening with the inside guide S1 positioned between the hooks for sealing of the hermetically sealable zipper comprising the male hook M2-1 and female hook F2-1, etc. and the hooks for slider guide comprising the G2-1 and G2-2.

Figure 10:
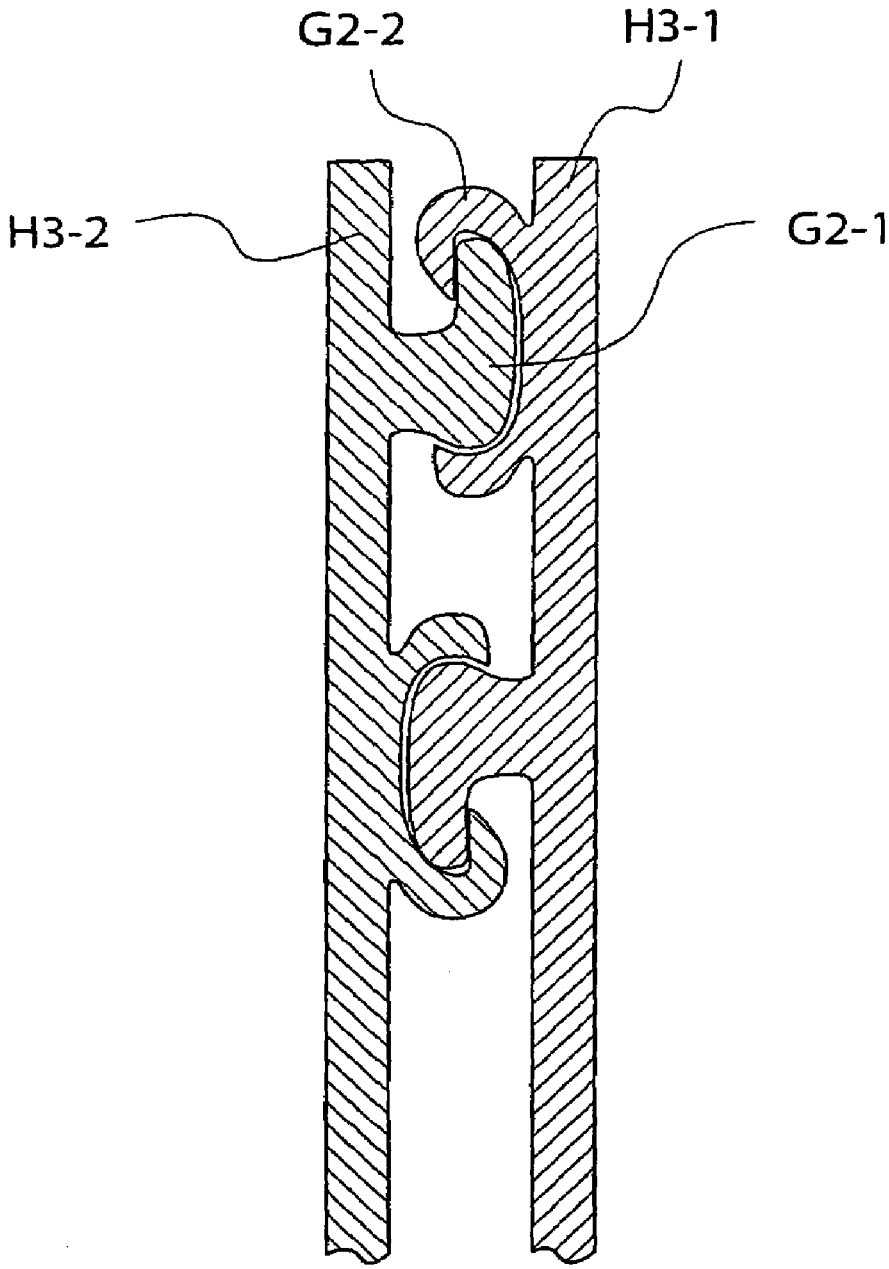
FIG. 10 is a cross sectional end view showing an ordinary plastic zipper which is equipped with a pair of hooks for the slider guide according to the present invention.

The hooks for slider guide may be equipped with a flange (shown as H3-1 and H3-2 on FIG. 9 through FIG. 10). However, the use of a flange an unreasonably large width brings about the possibility of being unfairly unsealed by grasping the flange in question. Such being the case, it is preferable that a flange is not installed at all, or it is installed so as to have a minimum required width in terms of manufacturing.

It is preferable that the hooks for slider guide are of such structure that an opening strength in the case of opening the hooks from the opening side is at least 4 kgf/50 mm, particularly at least 6 kgf/50 mm. When the opening strength is less than 4 kgf/50 mm, there is brought about the possibility of being unfairly unsealed, since the hooks are easily openable by hand. However in the case of opening the hooks for slider guide from the opposite side of the opening side, that is, from the side of the hooks for sealing, the opening strength need not be so high, and conversely unreasonably high opening strength unfavorably necessitates a strong force when opening the zipper by sliding the slider. It is preferable as illustrated on FIG. 9 and FIG. 10 to form the male and female hooks for the slider guide into bilaterally asymmetrical so that the opening strength varies depending upon the opening direction.

In the case where a measurement is made of the opening strength of a zipper which is not equipped with a flange or equipped with a flange having only a slight width, the flange is adhesively bonded to the zipper by the use of a supersonic welder or the like, taking sufficient care not to exert thermal influence on the hooks of the zipper.

In the following discussion, the present invention will be described in more detail with reference to comparative example and working example, which however shall never limit the present invention thereto.

EXAMPLE

There was prepared a flat bag which was sealed on three sides and which measured 140 mm wide by 200 mm high by the use of laminate films which had been dry laminated so that the bag inside consisted of 60 micron thick low density linear polyethylene resin and the bag outside consisted of 15 micron thick polyamide resin. Thereafter, the flat bag thus prepared was fitted with a hermetically sealable zipper as illustrated on FIG. 9 by heat sealing the flange portion on the content side of the zipper onto the inside of the opening end of the flat bag, wherein the hermetically sealable zipper mentioned above was composed of low density polyethylene resin as constructional material, and measured 3.9 mm wide by 2.6 mm thick in the zipper (the zipper constituted with a pair of male hook and female hook for sealing) in a state of engagement, 7 mm long in a flange on the content side of the zipper, and male and female hooks for the slider guide measuring 2.0 mm wide by 2.4 mm thick and having an opening strength from the opening side being 6 kgf/50 mm is installed at a position of 1.9 mm from the female hook F2-1 of the flange portion on the opening side.

Figure 1:
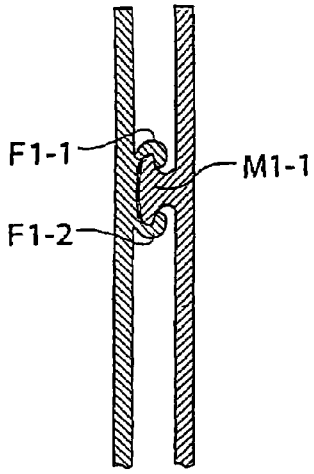
FIG. 1 is a cross sectional end view showing a conventional plastic zipper in a state of engagement.
Figure 2:
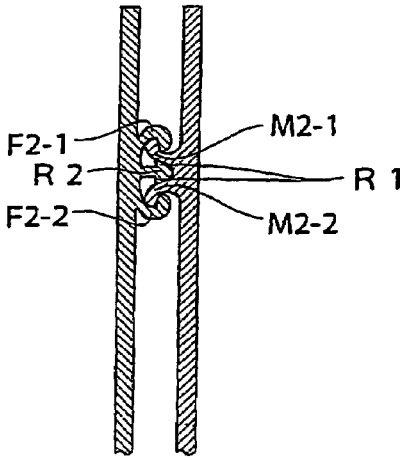
PRIOR ART Fig2
FIG. 2 is a cross sectional end view showing a hermetically sealable plastic zipper in a state of engagement.
Figure 3:
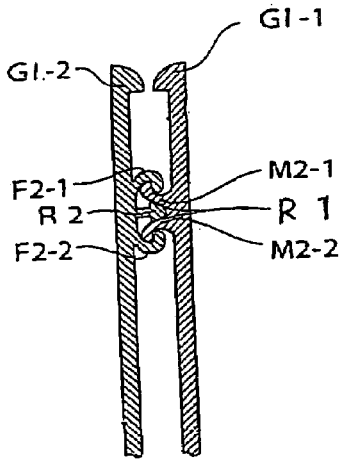
PRIOR ART Fig3
FIG. 3 is a cross sectional end view showing a hermetically sealable plastic zipper in a state of engagement, which is equipped with protrusions for slider guide.
Figure 4:
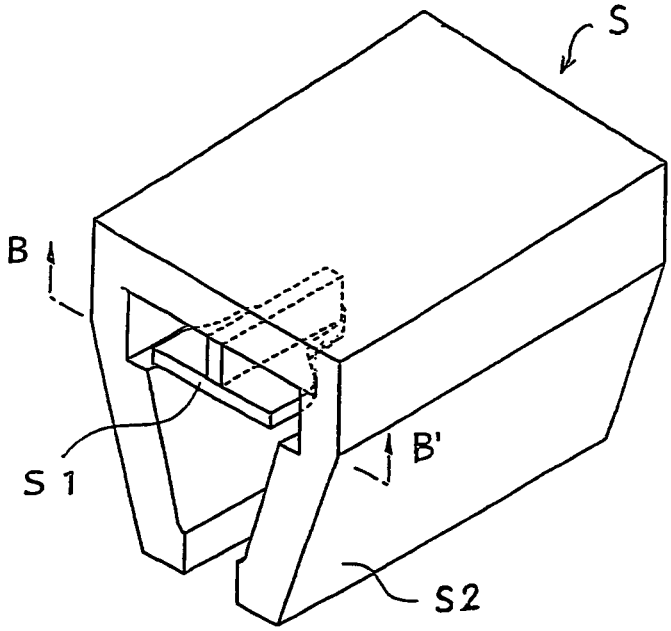
Fig4 PRIOR ART
FIG. 4 is a perspective view showing a slider to be used for a hermetically sealable plastic zipper which is equipped with protrusions for slider guide.
Figure 5:
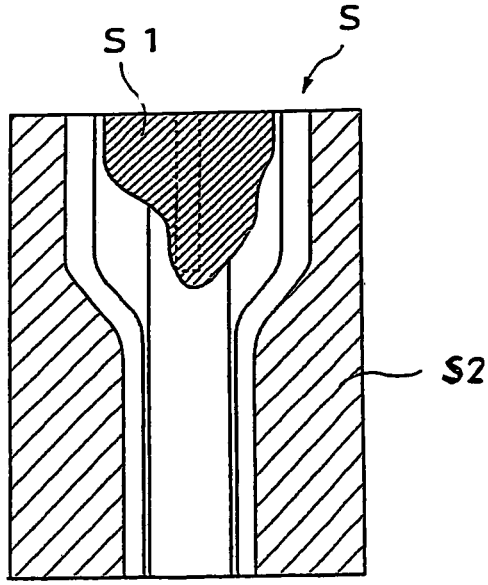
Fig5 PRIOR ART
FIG. 5 is a cross sectional view taken along line B–B' of FIG. 4.
Figure 6:
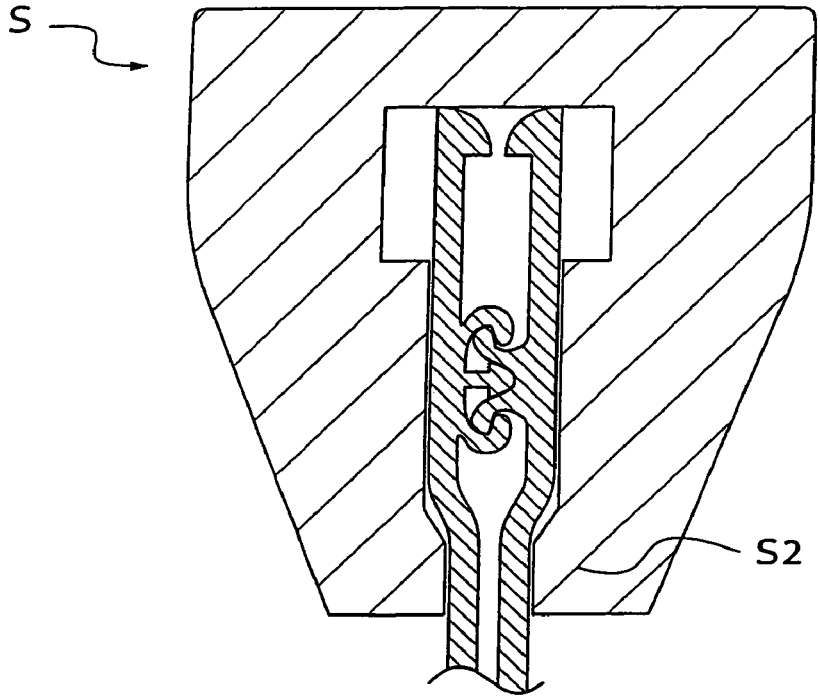
Fig6 PRIOR ART
FIG. 6 is a cross sectional end view showing a state in which a hermetically sealable plastic zipper which is equipped with protrusions for slider guide is closed by being sandwiched by the outside guide.
Figure 7:
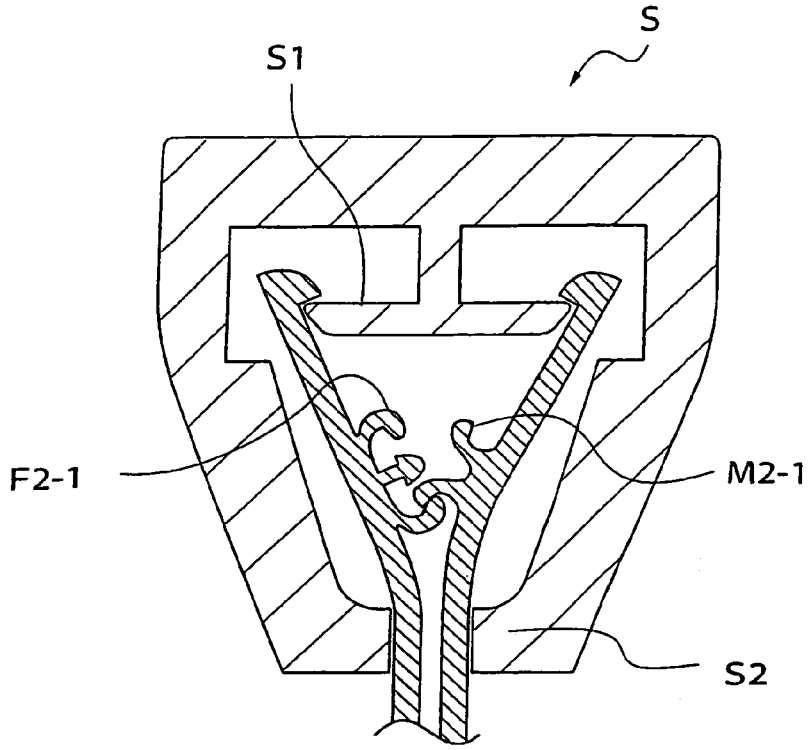
Fig7 PRIOR ART
FIG. 7 is a cross sectional end view showing a state in which a hermetically sealable plastic zipper which is equipped with protrusions for slider guide is opened by being widened by the inside guide.
Figure 8:
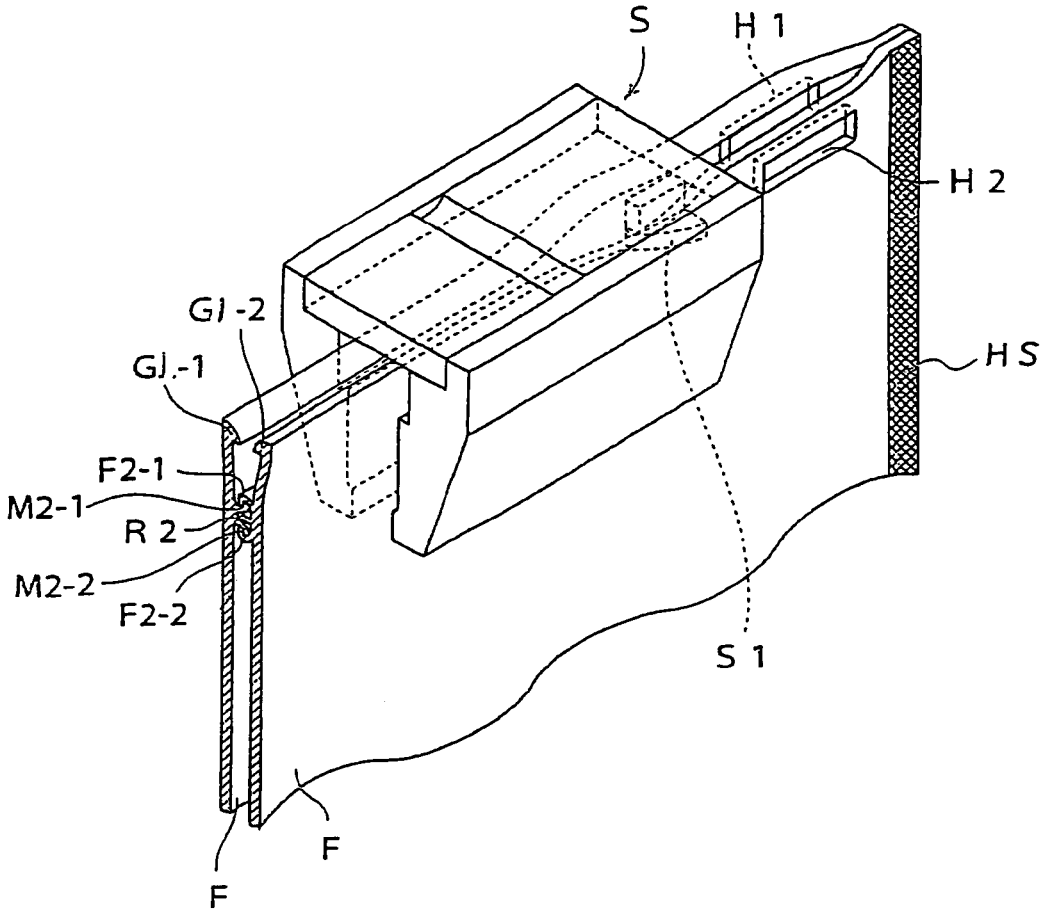
Fig8 PRIOR ART
FIG. 8 is a perspective view showing a bag body which is imparted with a function of stopping an inside guide for a slider.

Then a bag body fitted with a plastic zipper was prepared by installing hollows H-1, H-2 as illustrated on FIG. 8 each measuring 11 mm long by 1 mm wide between the hooks for sealing and the hooks for slider guide at a position of 0.5 mm from one side of the heat seal portions on both the ends of the zipper and squeezing-out the heat seal portion on the zipper to the inside of the bag by 6 mm at the closing end of the zipper. Further, the resultant bag body was fitted with a slider which was made of high density polyethylene and measured 11 mm long by 11 mm wide by 12 mm high, wherein the inside guide had a maximum width of 7 mm, so that a bag body fitted with the plastic zipper having the slider was prepared.

Subsequently, attempts were made to unseal from the outside, the bag bodies which had been prepared in the aforesaid manner at the portion where the zipper was closed by the use of the slider, but such unsealing was impossible.

Thereafter each often numbers of the above-prepared bag bodies were filled in with 700 milliliter of water by opening the plastic zipper with the slider, and then the zipper was closed with the slider. Subsequently, by a method in accordance with JIS Z-0238 each of the bag bodies to be tested was dropped from a drop height of 30 cm in such a direction that the horizontal portion of the bag body and the zipper impinged upon a floor surface. Further each of the bag bodies was compressed at 45 Kgf, and was checked for water leakage. As a result, any and all of the 10 bag bodies were completely free from water leakage.

Consequently, it has been proved that the bag body fitted with the plastic zipper fitted with a slider according to the present invention is surpassingly excellent in impact resistance and leakage resistance and at the same time, unfair unsealing of the zipper in a closed state was judged to be impossible.

INDUSTRIAL APPLICABILITY

According to the present invention, it has been made possible to provide a plastic zipper equipped with a slider capable of preventing unfair unsealing using a method other than the sliding of a slider, without impairing the hermetical sealability and other characteristic that are imparted inherently to the hooks for unsealing by virtue of the installation of the hooks for slider guide on the opening side of the zipper in addition to and aside from the hooks for unsealing.

The invention claimed is:

1. A plastic zipper equipped with a slider for preventing unintentional unsealing of the package, said slider having an inside slider guide, comprising a male hook and female hooks for sealing formed on a surface of a plastic film, and a second pair of hooks for said inside slider guide, said second pair of hooks including a male hook and a female hook which are installed parallel to the hooks for sealing on the opening side of the zipper so that said inside slider guide is positioned between the hooks for sealing and the hooks for said inside slider guide.

2. A plastic zipper equipped with a slider for preventing unintentional unsealing of the package, said slider having an inside slider, comprising a pair of male hooks and female hooks for sealing formed on a surface of a plastic film, a continuous tightening wall which is installed parallel to the male hooks and on the inside of the male hooks, a continuous pressing rib which is installed parallel to the female hooks and on the inside of the female hooks, and a pair of hooks including a male hook and a female hook for said inside slider guide which are installed parallel to the hooks for sealing on the opening side of the zipper so that said inside slider guide is positioned between the hooks for sealing and the hooks for said inside slider guide.

3. The plastic zipper according to claim 1, wherein the hooks for slider guide have each an opening strength of at least 4 kgf/50 mm as a strength of opening from the opening side.

4. A bag body fitted with the plastic zipper with a slider as set forth in claim 1.

5. The plastic zipper equipped with a slider and a preventive against unfair unsealing according to claim 2, wherein the hooks for slider guide have each an opening strength of at least 4 kgf/50 mm as a strength of opening from the opening side.

6. A bag body fitted with the plastic zipper with a slider as set forth in claim 2.

7. A bag body fitted with the plastic zipper with a slider as set forth in claim 3.

8. A bag body fitted with the plastic zipper with a slider as set forth in claim 5.

* * * * *